US005717184A

United States Patent [19]

Girodet et al.

[11] Patent Number: 5,717,184

[45] Date of Patent: Feb. 10, 1998

[54] HIGH-VOLTAGE CIRCUIT-BREAKER THAT INSERTS A RESISTANCE ON CLOSURE

[75] Inventors: Alain Girodet, Villeurbanne; Marc Vittoz, Lyons; André Cimala, Villeurbanne, all of France

[73] Assignee: Gec Alsthom T & D Sa, Paris, France

[21] Appl. No.: 787,012

[22] Filed: Jan. 29, 1997

[30] Foreign Application Priority Data

Jan. 31, 1996 [FR] France ..... 96 01129

[51] Int. Cl.[6] ..... H01H 9/30; H01H 33/14

[52] U.S. Cl. ..... 218/143; 218/1; 218/7

[58] Field of Search ..... 218/1–7, 14, 43–56, 218/57, 59–67, 68–80, 84, 119, 143, 144

[56] References Cited

U.S. PATENT DOCUMENTS 4,072,836 2/1978 Bischofberger et al. ..... 200/144 AP
5,304,760 4/1994 Pham et al. ..... 200/144 AP

FOREIGN PATENT DOCUMENTS

2612683A1 9/1988 France .
3242014A1 6/1983 Germany .
1063682 8/1959 Netherlands .

*Primary Examiner*—Michael L. Gellner
*Assistant Examiner*—Michael J. Hayes
*Attorney, Agent, or Firm*—Sughrue, Mion, Zinn, Macpeak & Seas, PLLC

[57] ABSTRACT

The present invention relates to a high-voltage circuit-breaker including a casing that is filled with a dielectric gas and that contains a first arcing contact and a second arcing contact, which arcing contacts are mounted to move in opposite directions from an open position to a closed position and vice versa, the first contact being secured by means of a ring to a tube mounted to slide in a support portion electrically connected to a terminal. Said ring is made of an insulating material, the first contact is extended by a rod that is in alignment with the contact, which rod is disposed on the side of the first contact that is further from the second contact, and is connected to a resistance, and said rod carries a switching member organized to connect said rod directly to said support portion during closure.

6 Claims, 5 Drawing Sheets

HIGH-VOLTAGE CIRCUIT-BREAKER THAT INSERTS A RESISTANCE ON CLOSURE

The present invention relates to a high-voltage circuit-breaker that inserts a resistance on closure.

It relates more particularly to a high-voltage circuit-breaker including a casing that is filled with a dielectric gas and that contains a first arcing contact and a second arcing contact, which arcing contacts are mounted to move in opposite directions from an open position to a closed position and vice versa, the first contact being secured by means of a ring to a tube mounted to slide in a support portion electrically connected to a terminal.

BACKGROUND OF THE INVENTION

Such contact configurations are commonly used in circuit-breakers, and in particular in "metal-clad" circuit-breakers, i.e. circuit-breakers enclosed in metal casings. Said ring is then conductive so as to enable current to pass from the first contact to said terminal.

In such a circuit-breaker, it can be necessary to insert a resistance on circuit-breaker closing as is conventional in high-voltage circuit-breakers, and as described, for example, in Patent Document FR-2 612 683 filed by the Applicant.

Unfortunately, in general, inserting a resistance requires the interrupting chamber to be specially made, and it involves installing parts of relatively large mass, and therefore requiring high drive energy.

OBJECTS AND SUMMARY OF THE INVENTION

An object of the invention is to provide a configuration for inserting a resistance on closure that can be adapted to suit the above-mentioned circuit-breaker without making any major changes in the interrupting chamber of the circuit-breaker, while enabling the size of said chamber to remain unchanged, and without requiring high drive energy.

To this end, according to the invention, said ring is made of an insulating material, the first contact is extended by a rod that is in alignment with the contact, which rod is disposed on the side of the first contact that is further from the second contact, and is connected to a resistance, and said rod carries a switching member organized to connect said rod directly to said support portion during closure.

To install the closure resistance it thus necessary, as regards the interrupting chamber, merely to replace the conductive ring with an insulating ring, and to install the extension rod.

In the preferred embodiment, the switching member is constituted by a ring carried by said rod and carrying means that can be locked in a snap-fastening portion carried by the support portion.

Preferably, said means are constituted by a thimble of flexible fingers having endpieces.

To enable the resistance to be inserted during at least a partial contact-opening stroke, the switching member is urged by a spring against an abutment secured to the rod, the thrust of the spring being directed in the same direction as the direction of the opening stroke of the first contact, and the rod carries a shoulder for disconnecting the switching member from the snap-fastening portion at the end of opening.

Advantageously, the electrical connection between the resistance and the rod is made via a tube into which the rod is inserted and which is equipped with a sliding contact.

BRIEF DESCRIPTION OF THE DRAWINGS

The invention is described below in more detail with reference to the following figures which show merely a preferred, embodiment of the invention.

MORE DETAILED DESCRIPTION

Figure 1A:
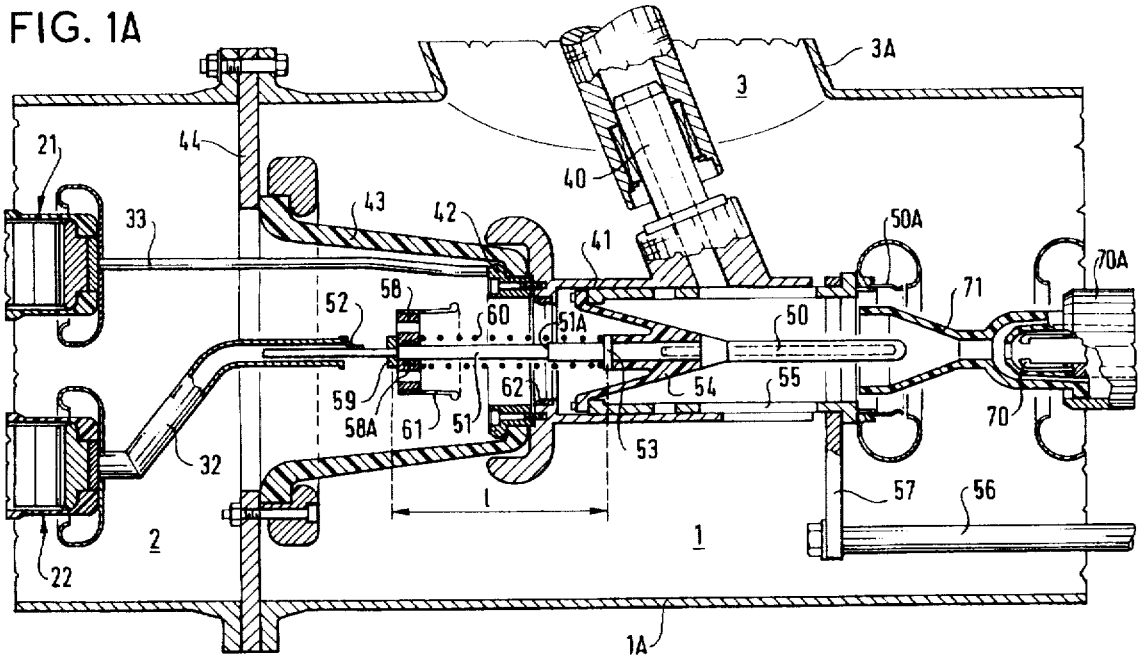
FIGS. 1*a* and *b* are fragmentary views, in longitudinal section through a circuit-breaker of the invention, in the open position.

The circuit-breaker shown is a high-voltage circuit-breaker enclosed in a metal casing and referred to as "metal-clad". The invention may be transposed to conventional equipment having a casing made of a ceramic or synthetic material.

It comprises an interrupting chamber 1 in a casing 1A, a resistance-receiving chamber 2 in a casing 2A, and a terminal chamber 3 of the deadtank type in a casing 3A.

The resistance is made up of two stacks of resistive pellets 21, 22 connected in series by means of a metal plate 23 supported by a cone 24 made of insulating material and fixed to a casing wall 25. Each of the stacks is mounted in a manner known per se in an insulating tube 26, 27 engaged in a metal part 28, 29 fixed to the plate 23 and retaining at its other end a metal block 30, 31 to which a metal rod 32, 33 is secured. The pellets are urged against the block 30, 31 by a spring 34, 35 interposed between the part 28, 29 and a metal contact pellet 36, 37 disposed at the base of each stack of resistive pellets.

The current can thus flow from the rod 32, referred to as the "input" rod, through the block 30, the first stack of resistive pellets 21, the contact pellet 36, the spring 34, the metal part 28, the plate 23, the metal part 29, the spring 35, the contact pellet 37, the second stack of resistive pellets 22, and the block 31 to arrive at the rod 33, referred to as the "output" rod, or else the current can flow in the opposite direction along the same path.

The output rod 33 is connected permanently to the terminal 40 of the chamber 3. For this purpose, the terminal 40 is secured to a tubular support part 41 disposed in the interrupting chamber 1 and receiving one of the arcing contacts, as described in more detail below. The tubular support part 41 is supported by a cone 43 made of an insulating material and fixed to a casing wall 44 separating the chambers 1 and 2, said part being supported by said cone by means of a metal ring 42 screwed onto the supporting part 41 and locking said cone 43 between it and the supporting part 41. The ring 42 is secured to the output rod 33 by means of a screwed spring contact, e.g. of the "FELS" type.

The first arcing contact 50 is received in the support part 41 and is constituted by a conventional endpiece extending by being screwed to a metal extension rod 51 which is inserted into the input rod 32 which is hollow, the input rod being electrically connected to the extension rod 51 by a sliding contact 52. Between the endpiece and a shoulder 53 on the extension rod 51, an optionally conical insulating ring 54 is disposed whose outer edge is fixed to a metal tube 55 mounted to slide in the support part 41. To drive the sliding, the tube 55 is secured to an insulating drive rod 56 via an arm 57 that is provided with an orifice through which the support part 41 is threaded.

Furthermore, the extension rod 51 carries a switching member 58 urged by a spring 60 against a ring, an abutment, or a shoulder 59 secured to the extension rod 51, which spring is interposed between the switching member 58 and the first shoulder 53. The switching member 58 is constituted by a ring mounted to slide on the extension rod 51 via a sliding contact 58A and carrying a thimble 61 of slightly flexible fingers having endpieces. The ring, abutment, or shoulder 59 and the first shoulder 53 are spaced apart by a length 1.

The support part 41 carries a snap-fasting annular part 62 disposed at its end and serving to receive and lock said fingers of the thimble 61 and to enable current to pass between the switching member 58 and the support part 41, as explained below.

The second arcing contact 70 is of the same type as the moving contact described in Patent Document FR-2 612 683, is shaped in a manner known per se, is made up of contact fingers, and is secured to moving equipment carrying a blast nozzle 71.

The two arcing contacts 50, 70 are thus moving contacts, and they can be actuated by a common drive device, in which case they can be moved at the same speed, or else they can be actuated by different drive devices, in which case they can optionally be moved at different speeds.

The circuit-breaker operates as follows.

Figure 1B:
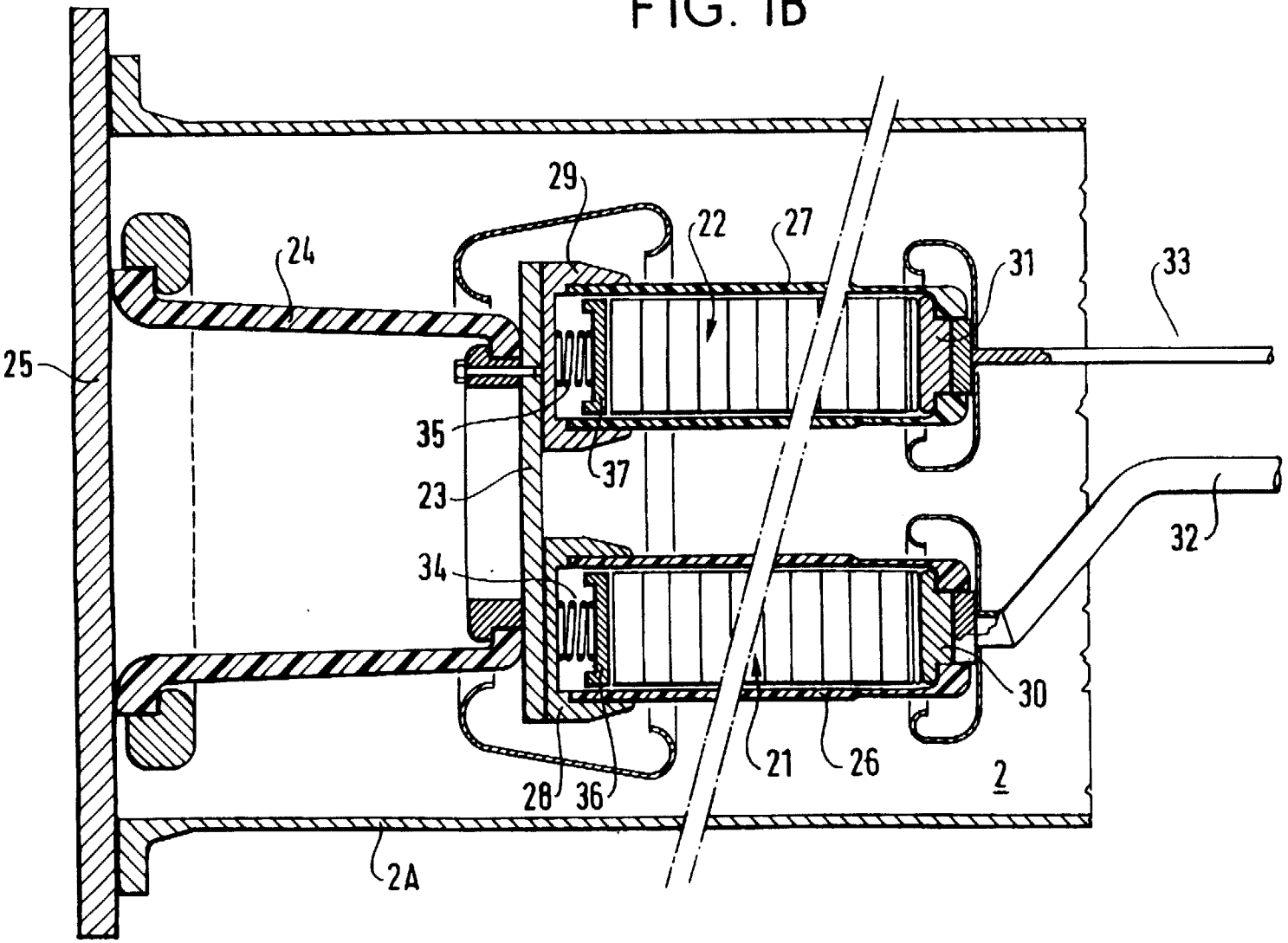

In FIG. 1, the circuit-breaker is shown in the open position. The arcing contacts 50, 70 are distant from each other, the tube 55 carrying the first arching contact 50 being in its left-most position, in which it is fully inserted into the tubular support part 41, and the moving equipment carrying the second arcing contact 70 is in its right-most position. The distance 1 is such that the switching member 58 is distant from the snap-fastening portion 62, and is situated at the end further from the contact 50. The support portion 41 and therefore the terminal 40 are thus not directly electrically connected to the extension rod 51, but rather they are connected via the resistance then inserted and bringing the arcing contact up to potential.

Figure 2:
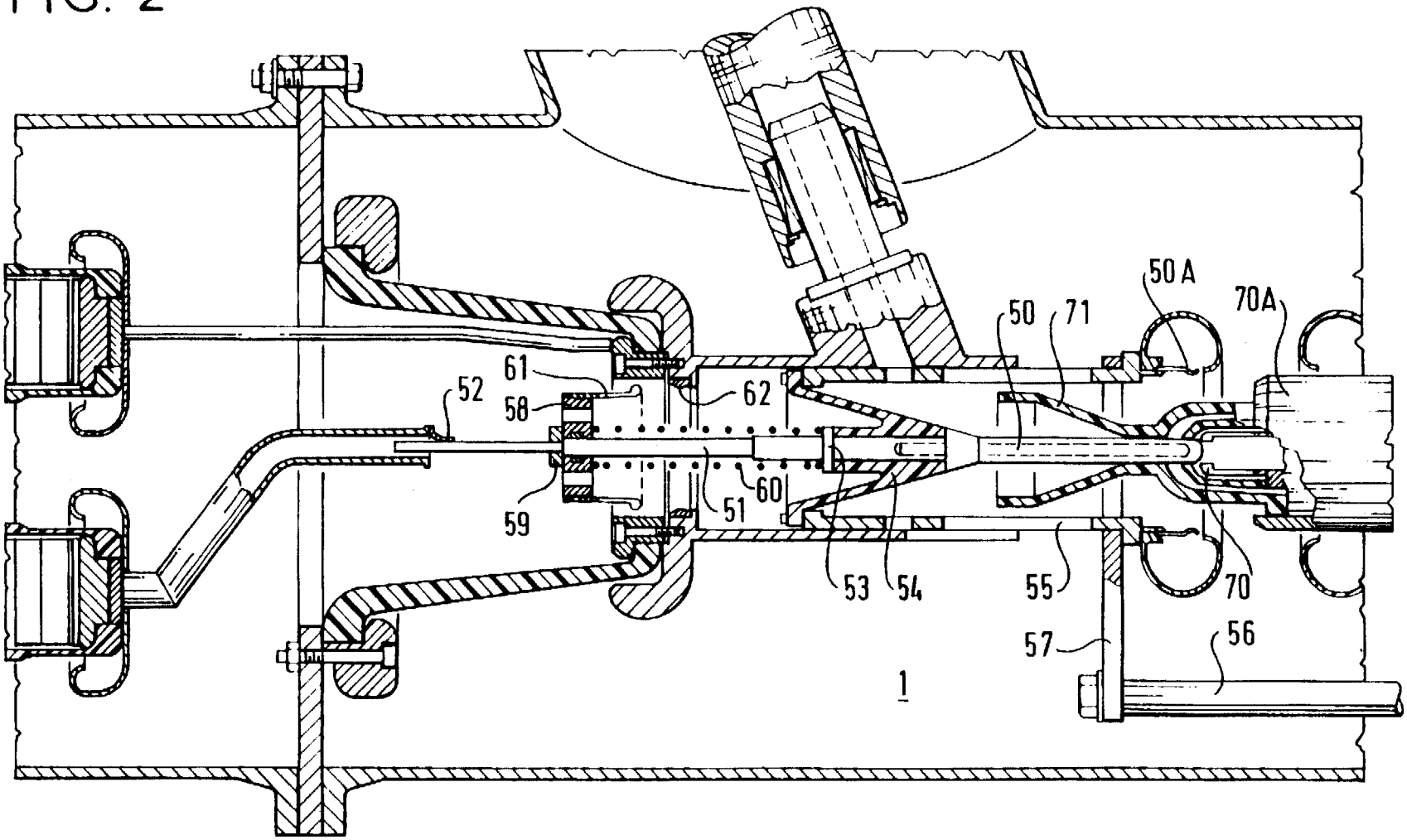
FIG. 2 is a fragmentary view in longitudinal section through a circuit-breaker of the invention, in a first intermediate position during closure.

During closing, the contacts 50, 70 are brought together by the action of the drive device(s). After the tube 55 and therefore the first arcing contact 50 have travelled over a first stroke, as shown in FIG. 2, the arcing contacts 50, 70 are in the vicinity of each other and an arc strikes. In this position, the switching member 58 is still distant from the snap-fastening portion 62, and the first contact 50 and the terminal 40 are not electrically interconnected. The resistance is therefore inserted, the current flowing through the second contact 70, the first contact 50, the extension rod 51, the input tube 32, the first stack of resistive pellets 21, the second stack of resistive pellets 22, the output tube 33, the part 42, the support portion 41, and the terminal 40.

The first contact 50 is inserted into the second contact 70, and the resistance remains inserted.

Figure 3:
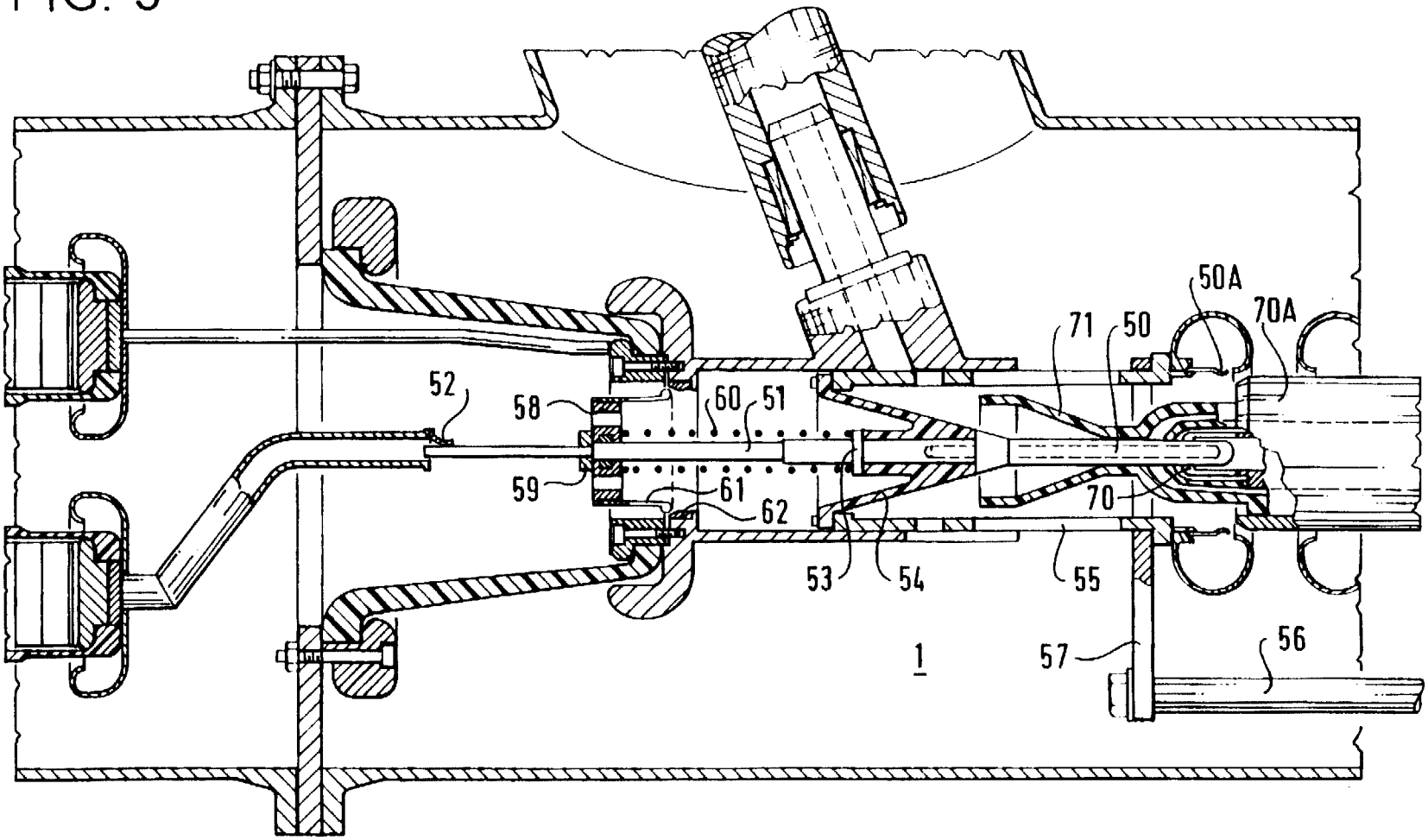
FIG. 3 is a fragmentary view in longitudinal section through a circuit-breaker of the invention, in a second intermediate position during closure.

Since contact closing continues, the contacts 50, 70 are interconnected as shown in FIG. 3, and the switching member 58 comes into contact with the snap-fastening portion 62, thereby electrically connecting said member to said snap-fastening portion. The resistance is thus short-circuited, the current passing through the second contact 70, the first contact 50, the extension rod 51, the switching member 58, the snap-fastening portion 62, the support portion 41, and the terminal 40.

Figure 4:
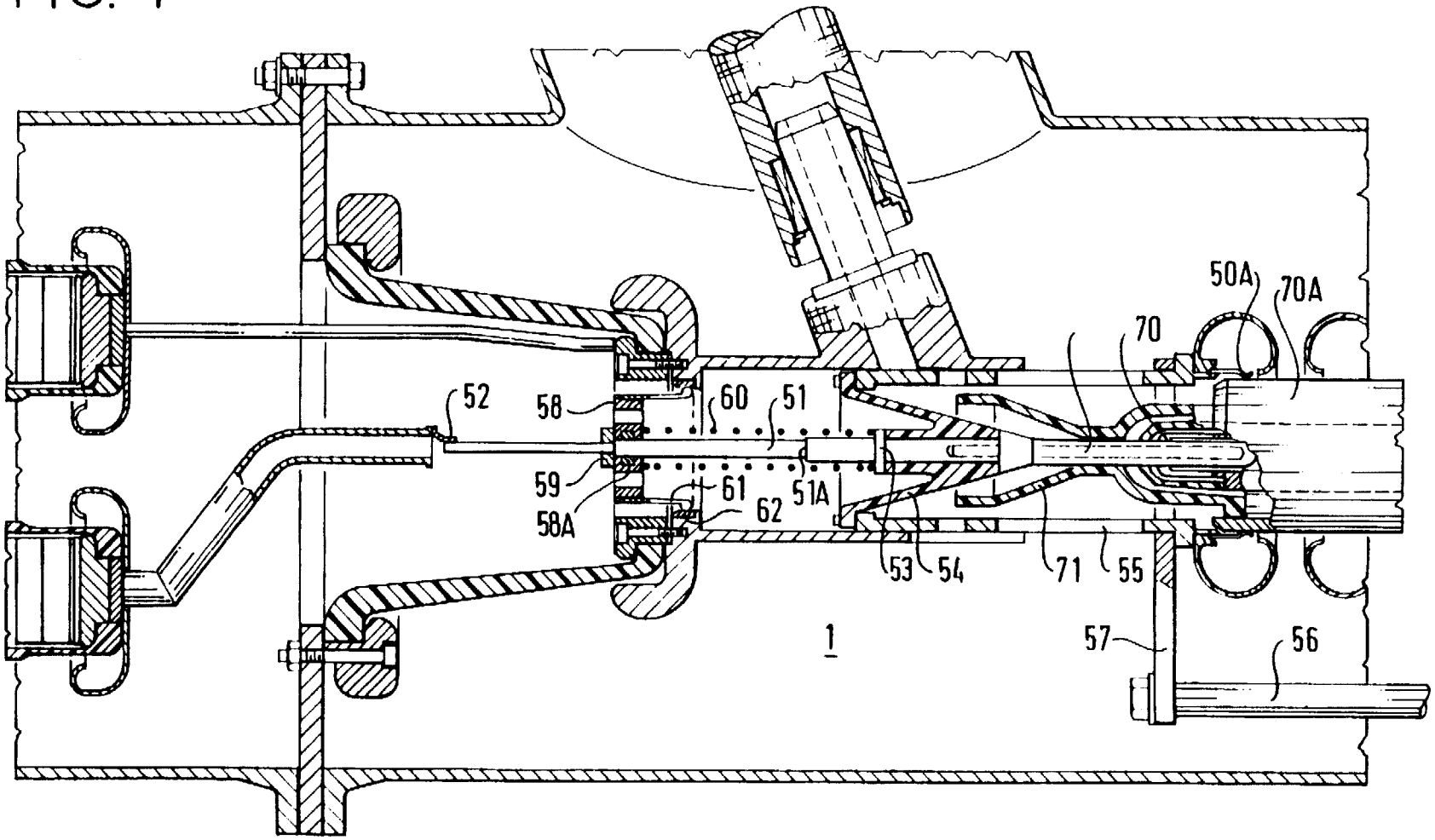
FIG. 4 is a fragmentary view in longitudinal section through the circuit-breaker of the invention, in the closed position.

Once the end of the closure stroke has been reached, as shown in FIG. 4, the switching member 58 has its fingers 61 snap-fastened in the snap-fastening portion 62. At the end of closure, the main contacts 50A and 70A come into contact with each other and enable the current to pass.

On opening, the contacts are displaced in the opposite direction, i.e. they are moved apart. The switching member 58 then continues to be snap-fastened in the snap-fastening portion 62 so long as a shoulder 51A has not reached the switching member 58. The shoulder 51A pushes the switching member 58 and releases it from the snap-fastening portion 62, then the spring 60 returns the switching member 58 to its initial position in which the circuit-breaker is open. The switching member 58 is released from the snap-fastening portion 62 in the vicinity of the fully open position or in said fully open position.

It is thus possible to set the insertion time of the resistance by appropriately choosing the actuating speed of the contacts 50, 70 and the distance 1.

We claim:

1. A high-voltage circuit-breaker including a casing that is filled with a dielectric gas and that contains a first arcing contact and a second arcing contact, which arcing contacts are mounted to move in opposite directions from an open position to a closed position and vice versa, the first contact being secured by means of a ring to a tube mounted to slide in a support portion electrically connected to a terminal, wherein said ring is made of an insulating material, wherein the first contact is extended by a rod that is in alignment with the contact, which rod is disposed on the side of the first contact that is further from the second contact, and is connected to a resistance, and wherein said rod carries a switching member organized to connect said rod directly to said support portion during closure.

2. A circuit-breaker according to claim 1, wherein the switching member is constituted by a ring carried by said rod and carrying means that can be locked in a snap-fastening portion carried by the support portion.

3. A circuit-breaker according to claim 2, wherein said means are constituted by a thimble of flexible fingers having endpieces.

4. A circuit-breaker according to claim 2, wherein the switching member is urged by a spring against an abutment secured to the rod, the thrust of the spring being directed in the same direction as the direction of the opening stroke of the first contact.

5. A circuit-breaker according to claim 4, wherein the rod carries a shoulder for disconnecting the switching member from the snap-fastening portion at the end of opening.

6. A circuit-breaker according to claim 1, wherein the electrical connection between the resistance and the extension rod is made via a hollow input rod into which the expansion rod is inserted and which is equipped with a sliding contact.

* * * * *